US011359897B2

(12) United States Patent
Mendes

(10) Patent No.: US 11,359,897 B2
(45) Date of Patent: Jun. 14, 2022

(54) BULLET

(71) Applicant: Fernando Ferreira Mendes, Edenvale (ZA)

(72) Inventor: Fernando Ferreira Mendes, Edenvale (ZA)

( * ) Notice: Subject to any disclaimer, the term of this patent is extended or adjusted under 35 U.S.C. 154(b) by 46 days.

(21) Appl. No.: 17/056,329

(22) PCT Filed: Jul. 12, 2019

(86) PCT No.: PCT/ZA2019/050037
§ 371 (c)(1),
(2) Date: Nov. 17, 2020

(87) PCT Pub. No.: WO2020/019005
PCT Pub. Date: Jan. 23, 2020

(65) Prior Publication Data

US 2021/0215466 A1 Jul. 15, 2021

(30) Foreign Application Priority Data

Jul. 16, 2018 (ZA) ..... 201804719

(51) Int. Cl.
*F42B 14/02* (2006.01)
*F42B 12/74* (2006.01)

(52) U.S. Cl.
CPC ..... *F42B 14/02* (2013.01); *F42B 12/74* (2013.01)

(58) Field of Classification Search
CPC ..... F42B 14/02; F42B 12/74
(Continued)

(56) References Cited

U.S. PATENT DOCUMENTS 1,107,948 A 8/1914 Hoagland
1,187,867 A 6/1916 Shinkle
(Continued)

FOREIGN PATENT DOCUMENTS

CH 32804 9/1905
WO WO-9961863 A2 * 12/1999 ..... F42B 14/02
(Continued)

OTHER PUBLICATIONS

Search report and written opinion dated Sep. 12, 2019 in International Application Serial No. PCT/ZA2019/050037.
(Continued)

*Primary Examiner* — Samir Abdosh
(74) *Attorney, Agent, or Firm* — Haugen Law Firm PLLP

(57) ABSTRACT

The present invention relates to a bullet. More particularly, the present invention relates to a bullet including concentric and sequentially ordered cylindrical fore, intermediate and aft portions. The aft portion comprises a cross-sectional diameter about equal to the diameter measured across the rifle landings of the riffled barrel operatively to create a gas pressure build up there-behind while the rifling grooves and lands deform and/or cut the aft portion thereby to impart spin to the bullet about the central axial axis thereof. The intermediate portion comprises a cross-sectional diameter smaller than that of the aft portion, which acts as a bearing surface for operatively riding along the rifling lands thereby to inhibit yawing of the bullet while operatively travelling through the rifled barrel. The fore portion comprises a cross-sectional diameter smaller than that of the intermediate portion with an annular stamping surface, for operatively providing a clean cut circular hunting wound, located at or near an interface between the fore and intermediate portions.

15 Claims, 5 Drawing Sheets

(58) Field of Classification Search
USPC ..... 102/524, 526, 527
See application file for complete search history.

(56) References Cited

U.S. PATENT DOCUMENTS

| | | | | |
|---|---|---|---|---|
| 5,164,538 | A | 11/1992 | McClain, III | |
| 5,686,693 | A | 11/1997 | Jakobsson | |
| 6,070,532 | A | 6/2000 | Halverson | |
| D456,480 | S | 4/2002 | Quinsa et al. | |
| 7,493,862 | B2 | 2/2009 | Orlanov | |
| 8,573,129 | B1 * | 11/2013 | Smitchko | F42B 14/02 102/524 |
| 10,830,564 | B1 * | 11/2020 | Langenbeck | F42B 14/02 |
| 2004/0050284 | A1 | 3/2004 | Piela | |
| 2007/0068415 | A1 * | 3/2007 | Oertwig | F42B 30/02 102/509 |
| 2007/0151474 | A1 | 7/2007 | Widener | |
| 2015/0226531 | A1 | 8/2015 | Silvers | |
| 2016/0025469 | A1 | 1/2016 | Nurminen | |
| 2016/0327380 | A1 * | 11/2016 | Kunz | F42B 10/44 |
| 2017/0089677 | A1 * | 3/2017 | Boatright | F42B 30/02 |
| 2017/0199019 | A1 | 7/2017 | Fricke et al. | |
| 2020/0363177 | A1 * | 11/2020 | Ruegsegger | F42B 5/32 |

FOREIGN PATENT DOCUMENTS

| | | | | |
|---|---|---|---|---|
| WO | WO-2018218292 | A1 * | 12/2018 | F42B 5/10 |
| WO | WO-2020214449 | A2 * | 10/2020 | F42B 14/02 |

OTHER PUBLICATIONS

Deadeye Dick's Shooting Supplies, "CE .308 190 Subsonic", Web page, <https://www.deadeyedicks.co.nz/product/cutting-edge-190-gr-subsonic-raptors-308/> , 2 pages, retrieved May 12, 2017.

Impala Bullets, "Bullet Design", Web page <http://impalabullets.co.za/bullet-design/>, 4 pages, Feb. 18, 2018, retrieved from Internet Archive Waback Machine <https://web.archive.org/web/20180218002316/http://impalabullets.co.za/bullet-design/> on Jan. 20, 2021.

* cited by examiner

BULLET

BACKGOUND OF THE INVENTION

The present invention relates to a bullet. More particularly, the present invention relates to a bullet including fore, intermediate and aft portions. The bullet is configured to inhibit yawing of the bullet while traveling through a rifled barrel thereby to maximize the accuracy of the bullet, while also enabling the cutting of a circular aperture in the hide of an animal hit by the bullet to ensure that the hide does not close and seal after the bullet has passed therethrough.

It is a common problem in the firing of bullets from rifled barrels that the bullet does not engage the rifling of the rifled barrel in a full annular ring on an entire outer surface of the bullet simultaneously, but rather on a first side of a central axis of the bullet prior to an opposing side thereof. When this occurs, the bullet yaws within the rifled barrel, and nutates as it travels along and out of the rifled barrel. Such a nutating movement is detrimental to the accuracy of the bullet and compromises the flight trajectory of the bullet. In order to combat the occurrence of yawing of a bullet within a rifled barrel, bullets having multiple portions dimensioned to engage various surfaces within the rifled barrel have been developed.

Of particular relevance is the bullet disclosed in U.S. Pat. No. 6,070,532, which describes a bullet configured to be fired from a rifled barrel, which bullet includes: (i) a fore portion adapted for impact with a target; (ii) a mid portion dimensioned to engage the radially inner surfaces of rifling lands within the rifled barrel; and (iii) an aft portion dimensioned diametrically slightly larger than a diameter defined between opposing rifling grooves, thereby to create a gas seal behind the bullet as it travels through the rifled barrel. The fore portion of this bullet, however, defines arcuately shaped sidewalls which increase in diameter moving from a nose toward the mid portion and terminates, at the transition point between the fore and intermediate portions, in a diameter substantially equal to the diameter of the cylindrical intermediate portion.

The aforementioned type of bullet, while being optimized for accuracy due to the mid portion inhibiting yaw while travelling through a rifled barrel, operatively pierces the hide of an animal and creates a relatively small aperture in such hide. This small aperture typically closes up after the bullet has passed through the hide and, consequently, leads to a very low rate of blood loss through such aperture. In cases where the bullet has not completely incapacitated the animal, such as in the case of a flesh wound, the animal flees and succumbs slowly or suffers for an extended period, while fleeing from the hunter, due to the limited blood loss. This not only results in prolonged suffering of the animal, but also represents a loss for the hunter.

Accordingly, it is an object of the present invention to overcome the shortcomings of the prior art by providing a bullet that is adapted to: (i) inhibit yawing during firing of the bullet; and (ii) provide a clean cut circular aperture in the hide of an animal that remains open after penetration of the bullet through such hide.

SUMMARY OF THE INVENTION

According to the invention there is provided a bullet, configured to be fired from a rifled barrel defining rifling lands and rifling grooves, including:

an aft portion comprising an aft body having opposing rear and forward axial ends, the aft body having a maximum cross-sectional diameter, as measured orthogonally across a central axial axis passing therethrough, that is smaller than or substantially equal to a cross-sectional diameter of the rifling grooves of the rifled barrel operatively to create a gas pressure build up behind the aft body as the bullet travels along the rifled barrel while the rifling grooves and lands deform and/or cut the aft body thereby to impart spin to the bullet about the central axial axis thereof;

an intermediate portion comprising a substantially cylindrically shaped intermediate body having opposing rear and forward axial ends, wherein the intermediate body: (i) extends, from its rear axial end, axially and concentrically from the forward axial end of the aft body; and (ii) comprises of a cross-sectional diameter, as measured orthogonally across the central axial axis, that is less than the maximum cross-sectional diameter of the aft body by between 0.1 and 0.4 millimeters, such that a radial outer surface of the intermediate body is sized and shaped to operatively ride in abutment along the rifling lands of the rifled barrel thereby to act as a bearing surface of the bullet, inhibiting yawing of the bullet while operatively travelling through the rifled barrel; and a fore portion comprising a fore body having, opposing rear and forward axial ends, wherein the fore body: (i) extends, from its rear axial end, axially and concentrically from the forward axial end of the intermediate body; and (ii) comprises of a cross-sectional diameter at its rear axial end, as measured orthogonally across the central axial axis, that is less than the cross-sectional diameter of the intermediate body by at least 0.5 millimeters, thereby to define on the forward axial end of the intermediate body, between respective radial peripheries of the intermediate and fore bodies, an annular stamping surface.

Preferably, the bullet further includes an annular cutting edge defined either:

(i) on the annular stamping surface; or (ii) on an annular cutting member protruding axially forwardly from the annular stamping surface;

wherein the annular stamping surface is defined radially between the cutting edge and the radial periphery of the fore body, and further wherein:

(i) where such annular stamping surface is a straight surface, the stamping surface comprises a stamping surface angle, as measured between such annular stamping surface and a foremost end of the central axial axis, of between 0 and 90 degrees; or (ii) where such annular stamping surface is curved, the stamping surface comprises a stamping surface angle, as measured between a tangential line touching the curved annular stamping surface immediately radially inwardly of the annular cutting edge and a foremost end of the central axial axis, of between 0 and 90 degrees.

Typically, the fore body has an axial length, as measured between the opposing rear and forward axial ends of the fore body, of between 7.5 and 47.0 percent of the combined axial length of the aft, intermediate and fore sections, as measured along the central axial axis.

Generally, the fore body has an axial length, as measured between the opposing rear and forward axial ends of the fore body, of between 2.5 and 15.0 millimeters.

Typically, the fore body is substantially cylindrical in shape and has a frustoconical tip at its forward end.

According to a preferred embodiment, the stamping surface extends orthogonally between respective radial peripheries of the intermediate and fore bodies, thereby to define the annular cutting edge at the radial periphery of the intermediate body.

Preferably, the intermediate body has an axial length, as measured between the opposing rear and forward axial ends of the intermediate body, of between 10.5 and 50.0 percent of the combined axial length of the aft, intermediate and fore sections, as measured along the central axial axis.

Preferably, the aft body has an axial length, as measured between opposing rear and forward ends of the aft body, of between 42.0 and 45.5 percent of the combined axial length of the aft, intermediate and fore sections, as measured along the central axial axis.

Generally, the intermediate body has an axial length, as measured between the opposing rear and forward axial ends of the intermediate body, of between 3.5 and 16.0 millimeters.

Generally, the aft body has an axial length, as measured between opposing rear and forward ends of the aft body, of between 13.5 and 14.5 millimeters.

Typically, the aft body defines at least three cannelures extending around the aft body, each of the cannelures including: (i) a valley recessed into the aft body to define a cannelure diameter that is less than or substantially equal to the diameter of the intermediate body for an axial length, as measured along the central axial axis of the bullet, of between 3.0 and 6.5 percent of the combined axial length of the aft, intermediate and fore sections, as measured along the central axial axis.

Generally, the cannelures extend for an axial length, as measured along the central axial axis of the bullet, of between 1.0 and 2.0 millimeters.

Optionally, the bullet further includes:

(i) a forward collection groove defined by and recessed into the intermediate body; and (ii) a rear collection groove defined by and recessed into the aft body, wherein each of the collection grooves includes: (a) a forward wall extending, radially outward and tapering toward the respective forward ends of the intermediate and aft bodies; and (b) a rear wall extending radially outward at an angle orthogonal with the central axial axis of the bullet.

Preferably, the rear collection groove defined by the aft body is located within the rearward most cannelure, such that: (i) the forward wall of the rear collection groove extends radially outward and tapers toward the forward end of the aft body and into the valley of the rearward most cannelure; and (ii) the rear wall of the rear collection groove extends radially outward at an angle orthogonal with the central axial axis of the bullet, thereby to form part of the rear wall of such cannelure.

Generally, the fore, intermediate and aft portions are integrally formed of a solid brass material.

BRIEF DESCRIPTION OF THE DRAWINGS

The invention will now be described in more detail, by way of example only, with reference to the accompanying drawings in which.

DETAILED DESCRIPTION OF THE INVENTION

Figure 1:
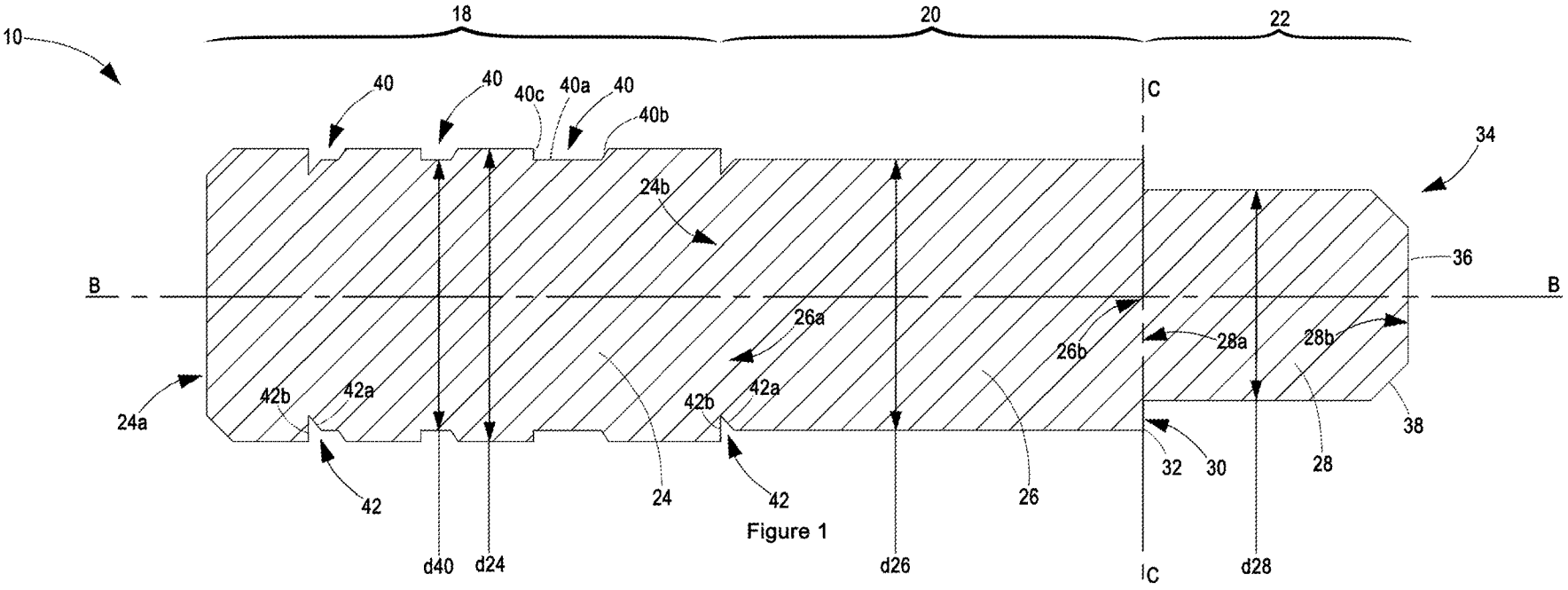
FIG. 1 is a cross-sectional side view of a bullet in accordance with the present invention.
Figure 2A:
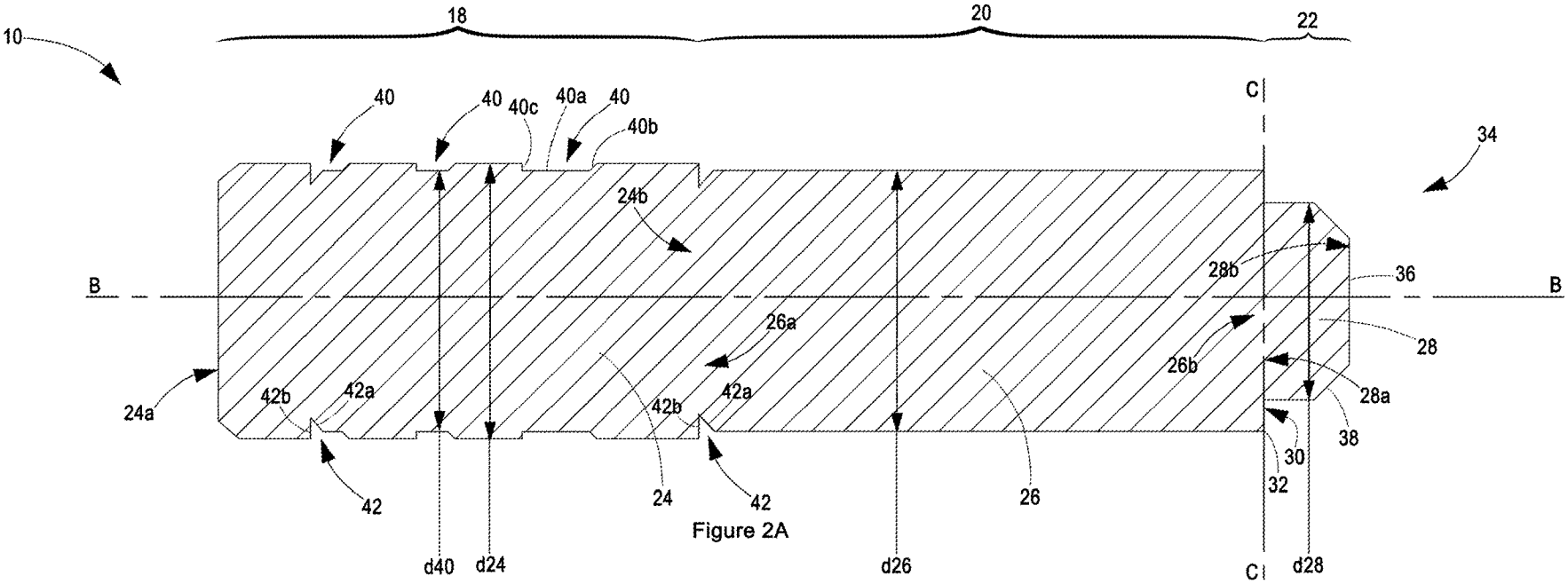
FIG. 2A is a cross-sectional side view of a first embodiment of a bullet in accordance with the present invention.
Figure 2B:
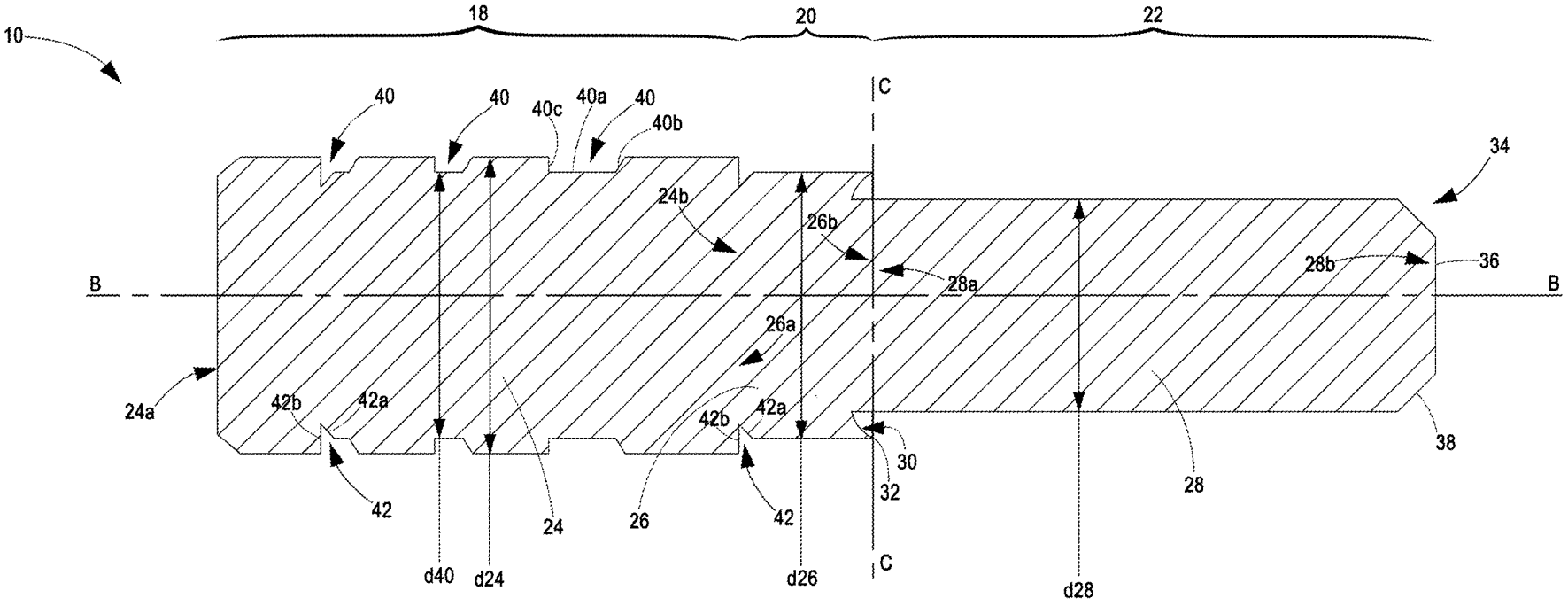
FIG. 2B is a cross-sectional side view of a second embodiment of a bullet in accordance with the present invention.
Figure 2C:
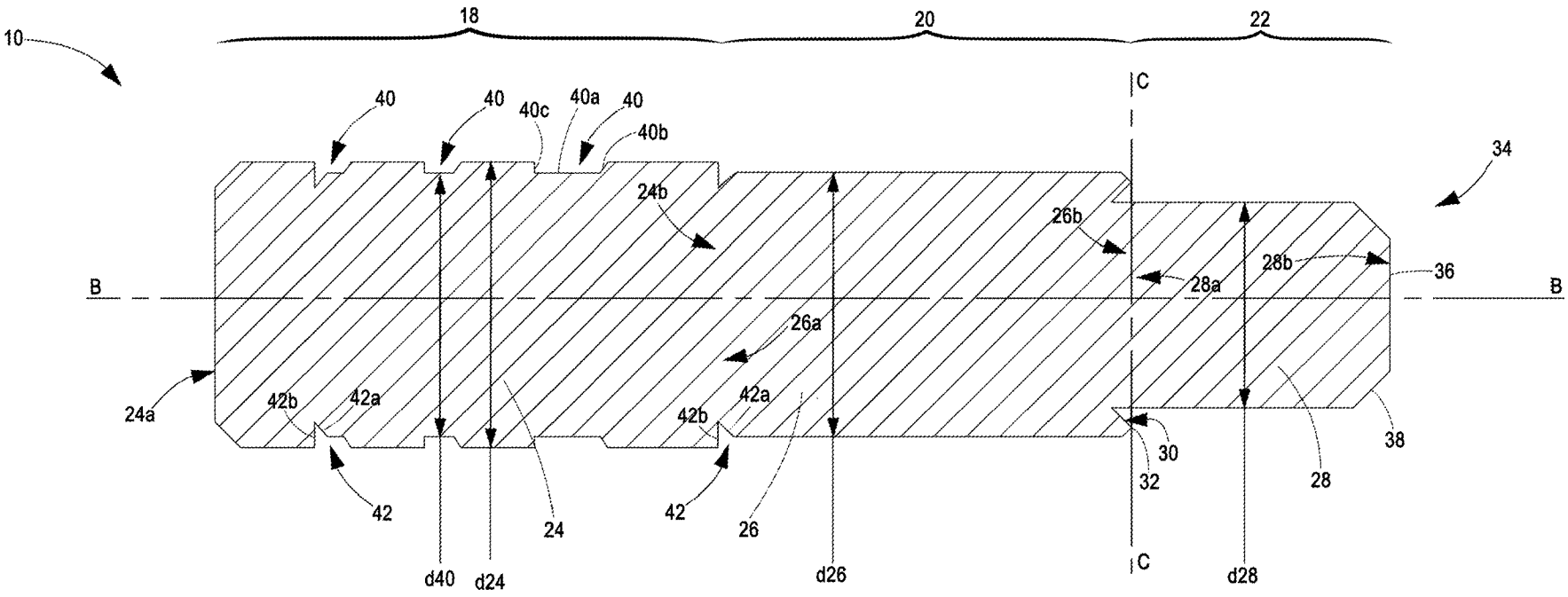
FIG. 2C is a cross-sectional side view of a third embodiment of a bullet in accordance with the present invention.
Figure 3:
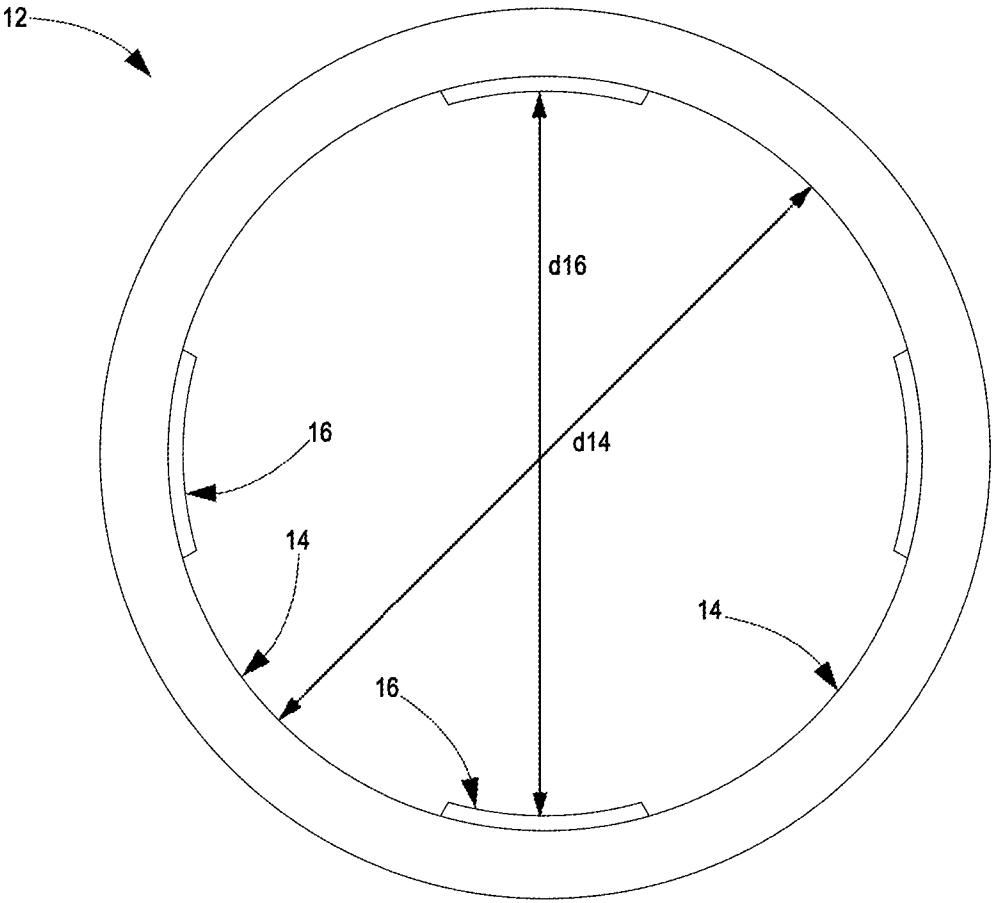
FIG. 3 is cross-sectional front view of a rifled barrel.

A bullet according to a preferred embodiment of the invention is designated generally in FIGS. 1 to 2C by reference numeral 10. The bullet 10 is configured to be fired from a rifled barrel 12 defining rifling grooves and lands 14, 16 extending in a spiraling arrangement along a longitudinal axis A-A defined by the rifled barrel 12, as best seen in FIG. 3. Opposing rifling grooves 14 define a groove diameter $d_{14}$ therebetween, while opposing rifling lands similarly define a land diameter $d_{16}$ therebetween. The bullet 10 includes an aft portion 18, an intermediate portion 20, and a fore portion 22.

The aft portion 18 comprises an aft body 24 having opposing rear and forward axial ends 24*a*, 24*b*. The aft body 24 has a maximum cross-sectional diameter $d_{24}$, as measured orthogonally across a central axial axis B-B passing therethrough, that is smaller than the rifled barrel 12 by 10 to 30 micrometers, or substantially equal to the cross-sectional diameter of the rifling grooves $d_{14}$ of the rifled barrel 12, operatively to create a gas pressure build-up behind the aft body 24 as the bullet 10 travels along the rifled barrel 12. For the purposes of this specification "substantially equal" permits a variance of 0.01 millimeters, which variance also applies as a typical machining tolerance to all dimensions specified. Operatively, as the bullet 10 travels along the rifled barrel 12, the rifling grooves and lands 14, 16 deforms and/or cuts the aft body 24 thereby to impart spin to the bullet 10 about the central axial axis B-B thereof, while simultaneously reducing the radial opening between the aft body 24 and the rifling grooves 14 of the rifled barrel 12 through displacement of the material due to such deformation and cutting of the aft body 24.

The aft body 24 has an axial length, as measured between opposing rear and forward ends 24*a*, 24*b* of the aft body 24, of between 42.0 and 45.5 percent of the combined axial length of the aft, intermediate and fore sections 18, 20, 22, as measured along the central axial axis B-B.

The intermediate portion 20 comprises a substantially cylindrically-shaped intermediate body 26 having opposing rear and forward axial ends 26*a*, 26*b*. The intermediate body 26 extends, at its rear axial end 26*a*, axially and concentrically from the forward axial end 24*b* of the aft body 24.

Further, the intermediate body 26 comprises of a cross-sectional diameter $d_{26}$, as measured orthogonally across the central axial axis B-B, that is less than the maximum cross-sectional diameter $d_{24}$ of the aft body 24 by between 0.1 and 0.4 millimeters, such that a radial outer surface of the intermediate body is sized and shaped operatively to fit between and ride in abutment along the rifling lands 16 of the rifled barrel 12, thereby to act as a bearing surface of the bullet 10. In this arrangement, the intermediate body 26 inhibits yawing and consequent nutation of the bullet 10 while travelling through the rifled barrel 12, thereby to ensure that the bullet 10 spins in a stable manner about the central axis B-B of the bullet 10 to maximize to the accuracy of the bullet 10.

The intermediate body 26 has an axial length, as measured between the opposing rear and forward axial ends 26*a*, 26*b* of the intermediate body 26, of between 10.5 and 50.0 percent of the combined axial length of the aft, intermediate and fore sections 18, 20, 22, as measured along the central axial axis B-B.

The fore portion 22 comprises a fore body 28 having opposing rear and forward axial ends 28*a*, 28*b*. The fore body 28 extends, from its rear axial end 28*a*, axially and concentrically from the forward axial end 26*b* of the intermediate body 26. The fore body 28 further has a cross-sectional diameter $d_{28}$ at the its rear axial end 28*a*, as measured orthogonally across the central axial axis B-B, that is less than the cross-sectional diameter of the intermediate body 26 by at least 0.5 millimeters, thereby to define on the forward axial end 26*b* of the intermediate body 26, between respective radial peripheries of the intermediate and fore bodies 26, 28, an annular stamping surface 30.

The fore body 28 has an axial length, as measured between the opposing rear and forward axial ends 28*a*, 28*b* of the fore body 28, of between 7.5 and 47.0 percent of the combined axial length of the aft, intermediate and fore sections 18, 20, 22, as measured along the central axial axis B-B.

The intermediate body 26 also includes an annular cutting edge 32 defined either: (i) on the annular stamping surface 30; or (ii) on an annular cutting member (not shown) protruding axially forwardly from the annular stamping surface 30. The annular stamping surface 30 is defined radially between the cutting edge 32 and the radial periphery of the fore body 28. Where the annular stamping surface 30 is a straight surface, a stamping surface angle $\alpha$, as measured between such annular stamping surface 30 and a foremost end of the central axial axis B-B, is between 0 and 90 (inclusive) degrees. Where the annular stamping surface 30 is a curved surface, a stamping surface angle $\alpha$, as measured between a tangential line C-C touching the curved annular stamping surface 30 immediately radially inwardly of the annular cutting edge 32 and a foremost end of the central axial axis B-B, is between 0 and 90 (inclusive) degrees.

With the stamping surface angle $\alpha$ no greater than 90 degrees, the cutting edge 32 cuts hide upon contact and does not merely stretch the hide to squeeze through an existing small aperture created by the fore body 28. In this configuration, the cutting edge 32 provides a clean cut circular aperture in the hide of an animal, with the hide located radially inward from the cutting edge 32 being moved away from the aperture by the stamping surface 30. Consequently, after the bullet 10 has moved through the hide, a clean cut circular aperture remains in the hide to provide an escape for any blood resulting from the damage caused within the body of the animal by the bullet 10.

The fore body 28 is substantially cylindrical in shape and has a frustoconical tip 34 at its forward end 28*b*. The frustoconical tip 34 defines:

(i) a substantially planar forward impact surface 36 for operatively stretching the hide in the area of impact by the bullet 10 to increase the effective size of the aperture cut and stamped from the hide by the cutting edge 32 and stamping surface 30 respectively; and (ii) an annular ring 38 tapering radially outward between the impact surface 36 and substantially cylindrical sidewalls of the fore body 28, thereby to: (a) upon loading, assist in guiding the bullet 10 into the rifled barrel 12 while inhibiting jamming of the bullet 10; and (b) upon contact with the hide of an animal, inhibit cutting of the hide by the tip 34 of the fore body 28.

Each of the cannelures 40 includes a valley 40*a* having a forward wall 40*b* and a rear wall 40*c*. The valley 40*a* is recessed into the aft body 24 to define a cannelure diameter $d_{40}$ that is less than or substantially equal to the diameter of the intermediate body 26 for an axial length, as measured along the central axial axis B-B of the bullet 10, of between 3.0 and 6.5 percent of the axial length of the bullet 10 as measured along the central axial axis B-B. The forward wall 40*b* extends radially outward from the valley 40*a* and tapers toward the forward end 24*a* of the aft body 24. The rear wall 42*b* extends radially outward from the valley 40*a* at an angle orthogonal with the central axial axis B-B of the bullet 10. Each of the cannelures 40 is configured to retain a lubricant (not shown) for operatively lubricating the rifled barrel 12 as the bullet 10 travels along the rifled barrel 12.

The bullet further defines a pair of collection grooves 42. The forward collection grooves 42 is defined by the intermediate body 26 at a location proximate the rear axial end 26*a* of the intermediate body 26. The rear collection groove 42 is defined by the aft body 24 at the location of the rear wall 40*b* of the cannelure 40 nearest the rear axial end 24*a* of the aft body 24. The collection grooves 42 are recessed radially into the intermediate and aft bodies 26, 24 respectively to corresponding depths relative to the longitudinal axis A-A, with: (i) the first collection groove 42 recessed into the intermediate body 26 to a depth of between 0.7 and 0.9 millimeters relative to the diameter of the aft body 24; and (ii) the second collection groove 42 recessed into the aft body 24 to a depth of between 0.7 and 0.9 millimeters relative to the diameter of the aft body 24.

Each of the collection grooves 42 has a forward wall 42*a* extending radially outward and tapering toward the respective forward ends 26*a*, 24*a* of the intermediate and aft bodies 26, 24. The forward wall 42*a* of the rear collection groove 42 extends radially outward and tapers into the valley 40*a* of the cannelure 40, while the rear wall 42*b* of such collection groove 42 extends radially outward at an angle orthogonal with the central axial axis B-B of the bullet 10, thereby to form part of the rear wall 40*c* of such cannelure 40.

The rearward most cannelure 40 is configured to act as a wiper for scraping and collecting any residue and/or loose material from within the rifled barrel 12 as the bullet 10 travels along the rifled barrel 12. Any residue and/or material collected by the rearward most cannelure 40, is deposited in the collection groove 42 and transported out of the rifled barrel 12 along with the bullet 10. In this manner, fowling of the rifled barrel 12 is decreased and the useful life of such rifled barrel 12 is consequently increased. Similarly, the forward collection groove 42 acts as a wiper while traveling along the rifled barrel 12 ahead of the aft body 12, thereby to minimize obstructions encountered by the aft body and consequently to maximise stability of the bullet 10 during travel through the rifled barrel 12.

The forward most cannelure 40 defined by the aft body 24 is configured to provide a securing and restricting groove for engaging a crimped edge of a bullet casing (not shown) within which the bullet 10 is operatively housed before firing. This groove enables effective mounting of the bullet 10 within a casing and inhibits and restricts movement of the bullet 10 relative to the casing while mounted therein. In this manner, operational and storage safety of the bullet 10 while mounted in a casing is ensured, as the forward most cannelure 40 prevents: (a) sinking of the bullet 10 into the casing which could lead to additional pressure on the propellant stored within such casing; and (b) sliding of the bullet 10 out of the casing thereby to alter the overall combined dimensions of the bullet 10 and casing.

It is preferred that the fore, intermediate and aft portions 18, 20, 22 of the bullet 10 are integrally formed of a solid brass material. The integral formation of the respective portions enables simple manufacturing through casting and subsequent machining. The brass material ensures high machinability during production, while operatively inhibiting fowling of the rifled barrels 12 and providing a projective that does not break apart upon contact, thereby to minimize contamination of meat.

The invention will now be described at the hand of three preferred embodiments of the invention, illustrated in FIGS. 2A to 2C, for use with rifled barrels 12 having similar groove diameters $d_{14}$, but differing land diameters $d_{16}$ for illustrative purposes, wherein the total length of the bullet 10 remains constant across all illustrated variants. In each of the illustrated embodiments, each of the aft, intermediate and fore portions 18, 20, 22 are dimensioned to provide the bullet 10 with a balanced mass distribution, thereby to ensure that the bullet 10 remains stable in flight to provide accurate firing of the bullet 10. The three illustrated embodiments of FIGS. 2A to 2C are dimensioned to correspond with typical .300 caliber bullets.

FIG. 2A shows the bullet 10 as dimensioned for relatively heavy mass. The fore body 22 having an axial length of 2.5 millimeters, the intermediate body having an axial length of 16.0 millimeters, and the aft body having an axial length of 13.5 millimeters. In this embodiment, the maximum cross-sectional diameter $d_{24}$ of the aft body 24 is illustrated as 7.81 millimeters, with the cross-sectional diameter $d_{26}$ of the intermediate body 26 being 0.2 millimeters smaller than the maximum cross-sectional diameter $d_{24}$ of the aft body 24.

Accordingly, this is intended for use with rifled barrels having a groove diameter of 7.81 to 7.83 millimeters and a land diameter of 7.61 to 7.63 millimeters. The fore body has a diameter $d_{28}$ of 5.6 millimeters. The stamping surface 30 extends orthogonally between respective radial peripheries of the intermediate and fore bodies 26, 28, thereby to define the annular cutting edge 32 at the radial periphery of the intermediate body 26 defining a stamping surface angle $\alpha$ of 90 degrees. The axial length of the fore body 28 is configured to stretch the hide of an animal without ever piercing or tearing such hide, thereby to enable the cutting edge 32 and stamping surface 30 to remove a circular portion of hide upon contact between the stretched hide and the intermediate body 26. The valleys 40*a* of the cannelures 40 are recessed to a depth of 0.1 millimeters and the cannelures extend for axial lengths of between 1.0 and 2.0 millimeters each, as measured along the central axial axis B-B.

FIG. 2B shows the bullet 10 as dimensioned for relatively light mass, with the fore body 22 having an axial length of 15 millimeters, the intermediate body having an axial length of 3.5 millimeters, and the aft body having an axial length of 13.5 millimeters. The maximum cross-sectional diameter $d_{24}$ of the aft body 24 is again illustrated as 7.81 millimeters, with the cross-sectional diameter $d_{26}$ of the intermediate body 26 being 0.3 millimeters smaller than the maximum cross-sectional diameter $d_{24}$ of the aft body 24.

Accordingly, this is intended for use with rifled barrels having a groove diameter of 7.81 to 7.83 millimeters and a land diameter of 7.61 to 7.63 millimeters. The fore body has a diameter $d_{28}$ of 5.6 millimeters. The stamping surface 30 extends at a progressively decreasing angle relative to the central axial axis B-B between respective radial peripheries of the intermediate and fore bodies 26, 28, thereby to define the annular cutting edge 32 at the radial periphery of the intermediate body 26 defining a stamping surface angle $\alpha$ of 30 degrees as measured between the tangent line C-C and the central axial axis B-B. The fore body 28 is configured to contact and then pierce the hide of an animal and to penetrate into the body of the animal while stretching the hide, thereby to enable the cutting edge 32 and stamping surface 30 to remove a circular portion of hide upon contact between the stretched hide and the intermediate body 26. The valleys 40*a* of the cannelures 40 are recessed to a depth of 0.25 millimeters and the cannelures extend for axial lengths of between 1.0 and 2.0 millimeters each, as measured along the central axial axis B-B.

FIG. 2C shows the bullet 10 as dimensioned for intermediate mass, with the fore body 22 having an axial length of 7.0 millimeters, the intermediate body having an axial length of 11.5 millimeters, and the aft body having an axial length of 14.5 millimeters. The maximum cross-sectional diameter $d_{24}$ of the aft body 24 is again illustrated as 7.81 millimeters, with the cross-sectional diameter $d_{26}$ of the intermediate body 26 being 0.2 millimeters smaller than the maximum cross-sectional diameter $d_{24}$ of the aft body 24.

Accordingly, this is intended for use with rifled barrels having a groove diameter of 7.81 to 7.83 millimeters and a land diameter of 7.61 to 7.63 millimeters. The fore body has a diameter $d_{28}$ of 5.6 millimeters. The stamping surface 30 extends from the radial periphery of the fore body 28 at an angle relative to the central axial axis B-B to define the annular cutting edge 32 at the radial midpoint between the radial peripheries of the intermediate and fore bodies 26, 28 and a stamping surface angle $\alpha$ of 45 degrees. The valleys 40*a* of the cannelures 40 are recessed to a depth of 0.1 millimeters and the cannelures extend for axial lengths of between 1.0 and 2.0 millimeters each, as measured along the central axial axis B-B.

Although the invention has been described with reference to preferred embodiments, it will be appreciated that many modifications and/or variations of the invention are possible without departing from the spirit or scope of the invention.

The invention claimed is:

1. A bullet, configured to be fired from a rifled barrel defining rifling lands and rifling grooves, including:

an aft portion comprising an aft body having opposing rear and forward axial ends, the aft body having a maximum cross-sectional diameter, as measured orthogonally across a central axial axis passing therethrough, that is smaller than or substantially equal to a cross-sectional diameter of the rifling grooves of the rifled barrel operatively to create a gas pressure build up behind the aft body as the bullet travels along the rifled barrel while the rifling grooves and lands deform and/or cut the aft body thereby to impart spin to the bullet about the central axial axis thereof;

an intermediate portion comprising a substantially cylindrically shaped intermediate body having opposing rear and forward axial ends, wherein the intermediate body: (i) extends, from its rear axial end, axially and concentrically from the forward axial end of the aft body; and (ii) comprises of a cross-sectional diameter, as measured orthogonally across the central axial axis, that is less than the maximum cross-sectional diameter of the aft body by between 0.1 and 0.4 millimeters, such that a radial outer surface of the intermediate body is sized and shaped to operatively ride in abutment along the rifling lands of the rifled barrel thereby to act as a bearing surface of the bullet, inhibiting yawing of the bullet while operatively travelling through the rifled barrel; and a fore portion comprising a fore body having opposing rear and forward axial ends, wherein the fore body: (i) extends, from its rear axial end, axially and concentrically from the forward axial end of the intermediate body; and (ii) comprises of a cross-sectional diameter at its rear axial end, as measured orthogonally across the central axial axis, that is less than the cross-sectional diameter of the intermediate body by at least 0.5 millimeters, thereby to define on the forward axial end of the intermediate body, between respective radial peripheries of the intermediate and fore bodies, an annular stamping surface.

2. A bullet in accordance with claim 1 including an annular cutting edge defined either:

(i) on the annular stamping surface; or (ii) on an annular cutting member protruding axially forwardly from the annular stamping surface;

wherein the annular stamping surface is defined radially between the cutting edge and the radial periphery of the fore body, and further wherein:

(i) where such annular stamping surface is a straight surface, the stamping surface comprises a stamping surface angle, as measured between such annular stamping surface and a foremost end of the central axial axis, of between 0 and 90 degrees; or (ii) where such annular stamping surface is curved, the stamping surface comprises a stamping surface angle, as measured between a tangential line touching the curved annular stamping surface immediately radially inwardly of the annular cutting edge and a foremost end of the central axial axis, of between 0 and 90 degrees.

3. A bullet in accordance with claim 2, wherein the fore body has an axial length, as measured between the opposing rear and forward axial ends of the fore body, of between 7.5 and 47.0 percent of the combined axial length of the aft, intermediate and fore sections, as measured along the central axial axis.

4. A bullet in accordance with claim 3, wherein the fore body has an axial length, as measured between the opposing rear and forward axial ends of the fore body, of between 2.5 and 15.0 millimeters.

5. A bullet in accordance with claim 4, wherein the fore body is substantially cylindrical in shape and has a frusto-conical tip at its forward end.

6. A bullet in accordance with claim 5, wherein the stamping surface extends orthogonally relative to the central axial axis between respective radial peripheries of the intermediate and fore bodies, thereby to define the annular cutting edge at the radial periphery of the intermediate body.

7. A bullet in accordance with claim 6, wherein the intermediate body has an axial length, as measured between the opposing rear and forward axial ends of the intermediate body, of between 10.5 and 50.0 percent of the combined axial length of the aft, intermediate and fore sections, as measured along the central axial axis.

8. A bullet in accordance with claim 7, wherein the aft body has an axial length, as measured between opposing rear and forward ends of the aft body, of between 42.0 and 45.5 percent of the combined axial length of the aft, intermediate and fore sections, as measured along the central axial axis.

9. A bullet in accordance with claim 8, wherein the intermediate body has an axial length, as measured between the opposing rear and forward axial ends of the intermediate body, of between 3.5 and 16.0 millimeters.

10. A bullet in accordance with claim 9, wherein the aft body has an axial length, as measured between opposing rear and forward ends of the aft body, of between 13.5 and 14.5 millimeters.

11. A bullet in accordance with claim 10, wherein the aft body defines at least three cannelures extending around the aft body, each of the cannelures including: (i) a valley recessed into the aft body to define a cannelure diameter that is less than or substantially equal to the diameter of the intermediate body for an axial length, as measured along the central axial axis of the bullet, of between 3.0 and 6.5 percent of the combined axial length of the aft, intermediate and fore sections, as measured along the central axial axis; (ii) a forward wall extending radially outward from the valley and tapering toward the forward end of the aft body; and (iii) a rear wall extending radially outward from the valley at an angle orthogonal with the central axial axis of the bullet.

12. A bullet in accordance with claim 11, wherein each of the cannelures defined by the aft body extends for an axial length, as measured along the central axial axis of the bullet, of between 1.0 and 2.0 millimeters.

13. A bullet in accordance with claim 12, further including:

(i) a forward collection groove defined by and recessed into the intermediate body; and (ii) a rear collection groove defined by and recessed into the aft body, wherein each of the collection grooves includes: (a) a forward wall extending radially outward and tapering toward the respective forward ends of the intermediate and aft bodies; and (b) a rear wall extending radially outward at an angle orthogonal with the central axial axis of the bullet.

14. A bullet in accordance with claim 13, wherein the rear collection groove defined by the aft body is located within the rearward most cannelure, such that: (i) the forward wall of the rear collection groove extends radially outward and tapers toward the forward end of the aft body and into the valley of the rearward most cannelure; and (ii) the rear wall of the rear collection groove extends radially outward at an angle orthogonal with the central axial axis of the bullet, thereby to form part of the rear wall of such cannelure.

15. A bullet in accordance with claim 13, wherein the fore, intermediate and aft portions are integrally formed of a solid brass material.

* * * * *